US005800049A

United States Patent [19]

Todd, Jr.

[11] Patent Number: 5,800,049

[45] Date of Patent: Sep. 1, 1998

[54] LIGHT ASSEMBLY FOR A CEILING FAN

[76] Inventor: Alvin E. Todd, Jr., 3360 Progress Hill Blvd., Pigeon Forge, Sevier County, Tenn. 37863

[21] Appl. No.: 574,127

[22] Filed: Dec. 18, 1995

Related U.S. Application Data

[63] Continuation-in-part of Ser. No. 301,658, Sep. 7, 1994.

[51] Int. Cl.[6] ..... F21V 33/00

[52] U.S. Cl. ..... 362/294; 362/96; 362/404

[58] Field of Search ..... 362/96, 294, 373, 362/404, 269, 418, 285, 427, 147; 416/5; 439/239, 240

[56] References Cited

U.S. PATENT DOCUMENTS

| | | | |
|---|---|---|---|
| 3,305,680 | 2/1967 | Berkl | 362/294 |
| 4,064,427 | 12/1977 | Hansen et al. | 362/96 |
| 4,685,038 | 8/1987 | Huang | 362/294 |
| 4,796,166 | 1/1989 | Greenberg | 362/96 |
| 5,028,206 | 7/1991 | Kendregan et al. | 416/5 |
| 5,072,341 | 12/1991 | Huang | 362/96 |
| 5,082,422 | 1/1992 | Wang | 416/5 |

*Primary Examiner*—Y. My Quach

*Attorney, Agent, or Firm*—Pitts & Brittian, P.C.

[57] ABSTRACT

A light assembly for securing to a ceiling fan. The light assembly includes a plurality of support arms, the first ends of which are secured to the ceiling fan via a securing device. A fixture is secured to the second end of each of the support arms for supporting a halogen bulb which is resistant to the effects of the heat emitted by a halogen bulb.

14 Claims, 3 Drawing Sheets

LIGHT ASSEMBLY FOR A CEILING FAN

This application is a Continuation-In-Part of Ser. No. 08/301,658, filed Sep. 7, 1994.

TECHNICAL FIELD

This invention relates to the field of ceiling fans and more specifically to light assemblies mounted on a ceiling fan.

BACKGROUND ART

Ceiling fans are widely used in homes to decorate the home as well as provide ventilation. Typically, ceiling fans are installed by removing an existing light fixture and replacing it with a ceiling fan resulting in a decrease in light available for illuminating a room. Often, ceiling fans are provided with lights which utilize incandescent light bulbs. The light that an incandescent bulb provides may be insufficient and not able to sufficiently illuminate a larger room. Therefore, it desirable to provide a light assembly which can be secured to ceiling fan for providing sufficient light which is able to illuminate a larger room.

Typical of the art are those devices disclosed in the patents listed below.

| Patent No. | Inventor | Date |
|---|---|---|
| 4,064,427 | Hansen et al. | Dec. 20, 1977 |
| 4,796,166 | Greenberg | Jan. 3, 1989 |
| 5,028,206 | Kendregan et al. | Jul. 2, 1991 |
| 5,072,341 | Huang | Dec. 10, 1991 |
| 5,082,422 | Wang | Jan. 21, 1992 |

U.S. Pat. No. 4,064,427 discloses a safety guard and light fixture attachment for a ceiling fan wherein individual lamp lights are secured to the outer surface of a guard. The guard surrounds the fan blades and is suspended from the ceiling plate and ceiling. The safety guard and light fixture attachment is complex and not easily secured to the existing ceiling fan.

U.S. Pat. No. 4,796,166 discloses a halogen spotlight assembly for a ceiling fan wherein the spotlight assembly is mounted on the ceiling fan and extends below the fan blades. A socket is provided for mating with a low watt halogen bulb. The socket is not fabricated to withstand the substantial heat produced by a higher watt halogen bulb. Obviously, a lower watt halogen bulb provides less light than a higher watt halogen bulb.

U.S. Pat. No. 5,028,206 discloses an illuminated ceiling fan wherein the neon tubes are secured to the outer periphery of each of the rotating blades. The neon tubes provide a limited amount of light due to their small size. Further, the neon tubes are fixed to the fan blades such that the tubes rotate with the fan blades which may result in an erratic light pattern.

U.S. Pat. No. 5,072,341 discloses a lamp assembly in which individual light units are secured to each fan blade. The light units rotate which may result in an erratic light pattern.

U.S. Pat. No. 5,082,422 discloses an illuminative fan wherein a plurality of light emitting diodes are disposed on each fan blade which are capable fo being flashed or colored to produce a variety of effects. The intention is to provide an erratic light pattern for decoration and not to sufficiently illuminate a room.

Therefore, it is an object of this invention to provide a light assembly for securing to a ceiling fan which provides sufficient light to room.

It is another object of the present invention to provide a light assembly which utilizes an improved bracket from mounting a halogen bulb therein.

Further, it is an object of the present invention to provide such a bracket which withstands the heat emitted from a higher watt bulb.

SUMMARY

Other objects and advantages will be accomplished by the present invention which provides a light assembly which can be secured to a portion of a ceiling fan for sufficiently illuminating a room. The light assembly of the present invention includes a plurality of support arms, the first ends of which are secured to a portion of a ceiling fan via a securing device. Each of the second ends of the support arms carries an illuminating unit.

BRIEF DESCRIPTION OF THE DRAWINGS

The above mentioned features of the invention will become more clearly understood from the following detailed description of the invention read together with the drawings in which.

DESCRIPTION OF THE PREFERRED EMBODIMENT

A light assembly for securing to an existing ceiling fan incorporating various features of the present invention is illustrated generally at 10 in the figures. The light assembly 10 is designed to provide more extensive illumination than a traditional ceiling fan which is equipped with a light assembly. Moreover, in the preferred embodiment, the light assembly 10 provides a fixture for supporting a halogen bulb.

Figure 1:
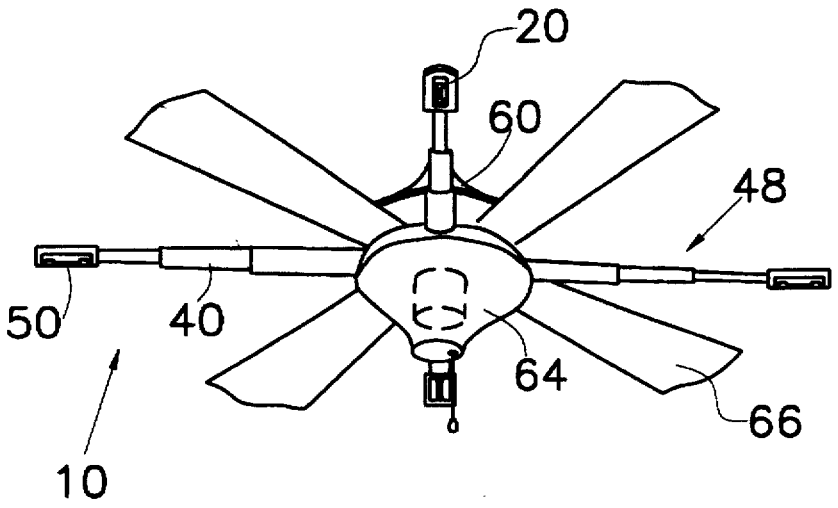
FIG. 1 is a perspective view of the light assembly for securing to a ceiling fan constructed in accordance with several features of the present inventions.

The light assembly 10 of the present invention is configured to secure to an existing ceiling fan 60. A conventional ceiling fan 60 is suspended from a ceiling, as shown in FIG. 1. The electrical box which powers the ceiling fan 60 is mounted in the ceiling. The ceiling fan motor 68 which rotates the blades 66 is in electrical communication with the electrical box in the ceiling.

The light assembly 10 is generally comprised of a securing device 11 for securing the first end 42 of a plurality of support arms 40 to an existing ceiling fan 60, the second end 46 of each of the support arms 40 supports an illuminating unit 50.

Figure 3:
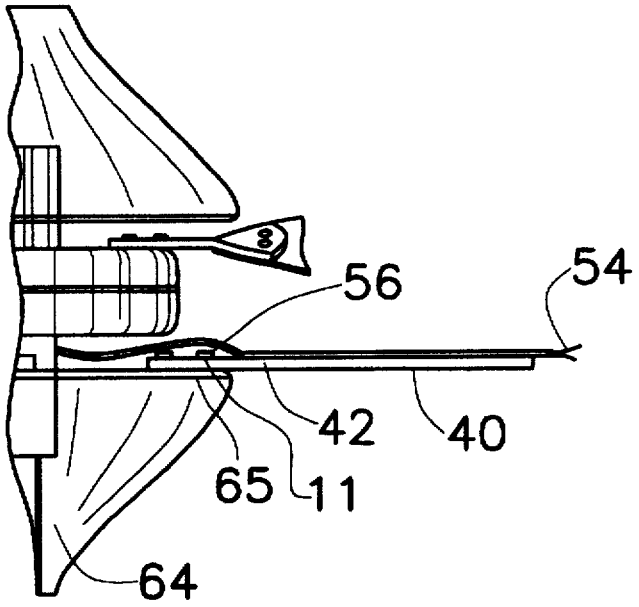
FIG. 3 is a partial side view of the support arm for the light assembly of FIG. 1.

In the embodiment depicted in FIG. 1, the light assembly 10 is secured to a ceiling fan 60 without an available shaft. The ceiling fan 60 depicted is a conventional ceiling fan 60 with opposing domes 64 which provide a decorative effect. The securing device 11 is a plurality of screws 56 which secure the first ends of the support arms 40 directly to the upper surface 65 of the lower dome, as shown most clearly in FIG. 3. It will be noted that other means for securing the arms to a ceiling fan with or without an available shaft can be utilized. For example, in an alternate embodiment (not shown), the support arms are secured to an adaptor which is secured around the shaft of a ceiling fan.

Figure 2:
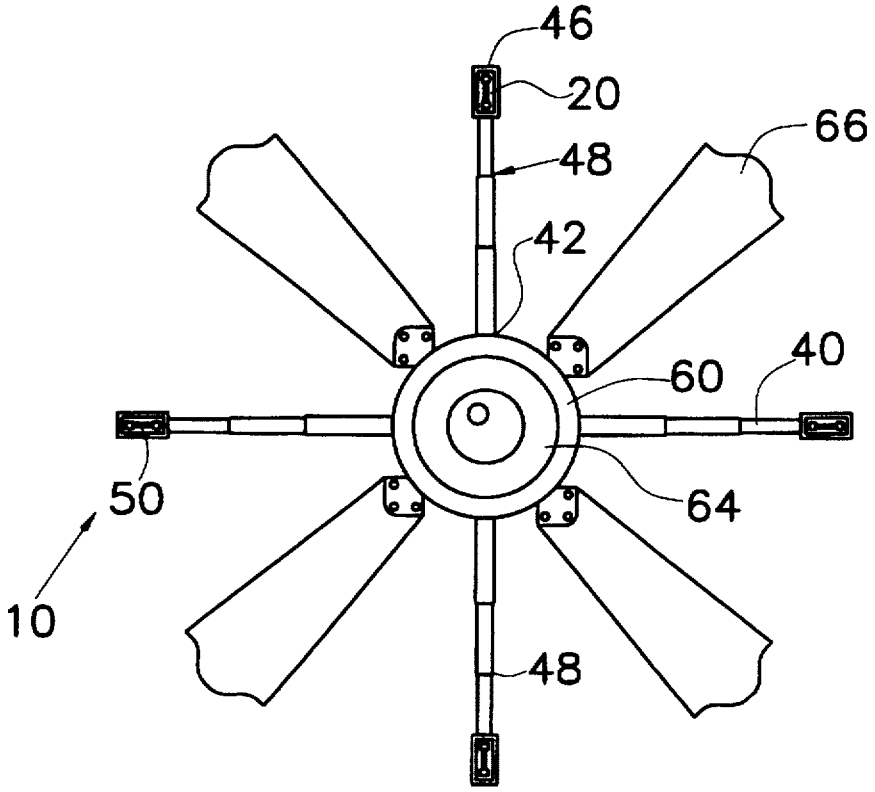
FIG. 2 is a plan view of an embodiment of the light assembly of the present invention.

In the preferred embodiment, each of the support arms 40 defines a length adjustor 48 such that the distance the support arms 40 extend from the ceiling fan is adjustable. Preferably, the length of each of the support arms 40 is adjustable in a telescoping manner, as illustrated in FIGS. 1 and 2. The telescopic support arms 40 can be controlled manually or remotely.

Figure 5:
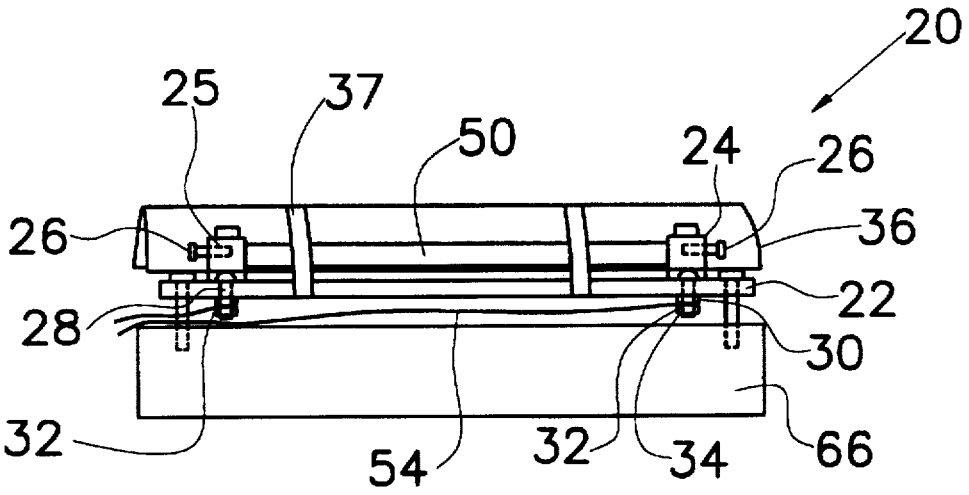
FIG. 5 is side view of the fixture for retaining a halogen bulb of the present invention.

In the preferred embodiment, the second end 46 of each of the support arms 40 carries a halogen light bulb 50. In the preferred embodiment, a fixture 20 which retains the halogen bulb 50 is secured to the second end 46 of the respective support arm 40. Each halogen bulb 50 is powered in a typical manner. As shown in FIG. 5, lead wires 54 extend from the fixture 20 retaining the halogen bulb 50 to the main body of the ceiling fan 60. In the preferred embodiment, the lead wires 54 are inserted into the shaft of the ceiling fan and run up the interior of the shaft 62. The lead wires 54 are electrically wired to the electrical box within the ceiling (not shown). It is preferable that the lead wires 54 are secured to the support arm 40 along which the lead wires 54 extend.

Figure 4:
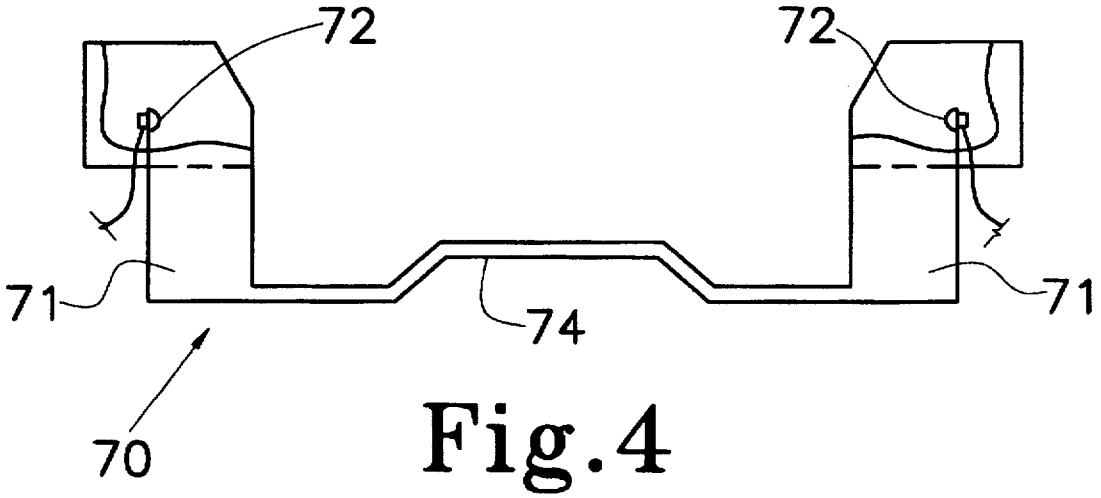
Fig.4 (PRIOR ART)
FIG. 4 is a view of a prior art fixture for retaining a halogen bulb.
Figure 6:
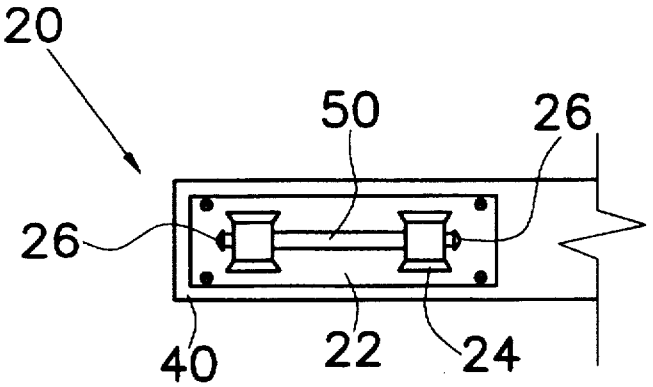
FIG. 6 is a top view of the fixture of FIG. 5.

The halogen bulb 50 is mounted in a fixture 20, as shown in FIGS. 5 and 6. In the preferred embodiment, the halogen bulb 50 is 100–300 watts. A fixture 70 for holding a halogen bulb 50 of the prior art is depicted in FIG. 4. The fixture 70 is comprised generally of two ceramic pieces 71 spaced apart by a metal bracket 74. Each ceramic piece 71 includes a metal tab 72 which contacts the metal end portion of a halogen bulb 50. The bulb 50 is held in place between the two tabs 72 via tension established by the tabs 72 when the bulb 50 is inserted therebetween. When a halogen bulb 50 is powered, it produces an excessive amount of heat which ultimately causes the metal tabs 72 to soften and release the tension thereby releasing the bulb 50.

The fixture 20 of the present invention is comprised generally of a base 22 to which two mounting brackets 24 are mounted, as shown in FIGS. 5 and 6. The mounting brackets 24 are spaced apart to receive a halogen bulb 50 therebetween. The mounting brackets 24 are configured to transmit electricity from a source to the halogen bulb 50. In the preferred embodiment, each of the mounting brackets 24 defines a male thread opening 25 for receiving a set screw 26. The set screws 26 cooperate to hold the halogen bulb 50 therebetween. Further, each of the set screws 26 contacts the respective metal ends defined by the halogen bulb 50. The halogen bulb 50 is powered by an electrical connection between the set screws 26 and a source. It will be noted that the heat emitted by the bulb 50 will not affect the retention of the bulb 50 between the two set screws 26 because the set screws 26, if softened, do not back up through their respective threaded openings 25.

In the preferred embodiment, the base 22 is fabricated from a high temperature material such as a ceramic, and the mounting brackets 24 and set screws 26 are fabricated from brass. Preferably, the ceramic base 22 is coated with a glaze which prevents the deterioration of the ceramic resulting from the high heat emitted from a higher watt halogen bulb.

In the preferred embodiment, each of the mounting brackets 24 is secured to the base 22 via a screw 28 fed through the bottom of the respective mounting bracket 24 and the base 22 and held in place by a nut 30. The screw 28 serves as a post to which a lead wire 54 is connected in any conventional manner. In the embodiment depicted in FIG. 5, the eye of a terminal 32 is looped around the lower end of the screw 28 and held in place with a second nut 34. The lead wires 54 are in electrical communication with a source and provide power to the halogen bulb 50 through the mounting brackets 24 and their respective set screws 26. A lead wire 54 is connected to the terminal 32. The lead wires 54 are located under the base 22 to protect them from heat damage. Further, in the preferred embodiment, a dome 36 is utilized to protect the bulb 50 and dissipate heat from the bulb 50. The dome 36 is releasably secured to the base 22 in any manner. In the embodiment depicted in FIG. 5, two bands 37 are wrapped around the dome 36 and the base 22.

Figure 7:
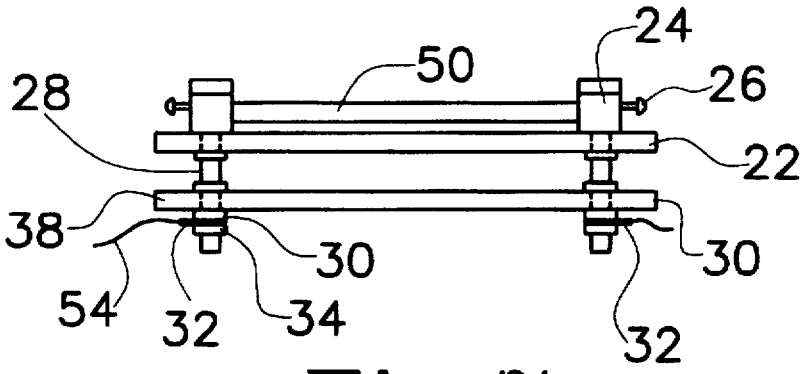
FIG. 7 is an alternate embodiment of the fixture.

In an alternate embodiment depicted in FIG. 7, a second ceramic plate 38 is spaced apart from the base 22 and provides added protection to the lead wires 54 and the support arm from the high heat emitted from the halogen bulb 50. Both of the screws 28 which secure a respective mounting bracket 24 to the base 22 extend through the second plate 38 and electrical connections are established behind the second plate 38.

In an alternate embodiment (not shown), an electrical outlet, with which the illuminating unit is capable of communicating, is incorporated into the ceiling fan such that a DC powered device such as a generator can be plugged into the outlet thereby powering the illuminating unit.

In the preferred embodiment, the second end 46 of each of the support arms 40 is rotatable such that the respective halogen bulb 50 can be directed toward the floor or toward the ceiling. Preferably, the second end 46 is carried by the support arm 40 in any suitable manner which permits rotation of the second end 46. Further, it is preferable that the rotation of the second end 46 is limited to 180° such that the lead wires do not become wrapped around the support arm 40. It will be noted that the entire support arm can be rotatable.

From the foregoing description, it will be recognized by those skilled in the art that a light assembly for securing to a ceiling fan offering advantages over the prior art has been provided. Specifically, the light assembly provides sufficient illumination to a room and illuminates a large portion of a room. Further, the light assembly includes a fixture for retaining a halogen bulb which is resistant to the effects of the heat emitted by a halogen bulb.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A light assembly for securing to an existing ceiling fan, said light assembly comprising:

a plurality of support arms radially extending from and connecting to the ceiling fan, each of said plurality of support arms defining a first end and a second end;

a fixture secured to said second end of each of said plurality of support arms, said fixture defining a base and a first and second mounting bracket secured to said base; and a halogen bulb being supported by said fixture, said first and second mounting brackets being positioned to receive said halogen bulb therebetween, said first and second mounting brackets transmitting electricity from a source to said halogen bulb to power said halogen bulb.

2. The light assembly of claim 1 wherein each of said first ends of said plurality of support arms is secured directly to a portion of the ceiling fan.

3. The light assembly of claim 1 wherein each of said plurality of support arms defines a length adjustor for adjusting a length of each of said plurality of support arms extends from the ceiling fan.

4. The light assembly of claim 1 wherein each of said plurality of support arms is telescopic such that a length of each of said plurality of support arms extends from the ceiling fan is adjustable.

5. The light assembly of claim 1 wherein each of said second ends of said plurality of support arms is rotatable such that said halogen bulb is directable toward a ceiling and a floor.

6. The light assembly of claim 1 wherein each of said first and second mounting brackets includes a post which extends through said base and receives an electrical connection in communication with the source.

7. The light assembly of claim 1 wherein each of said first and second mounting brackets includes a threaded opening for receiving a threaded screw, said threaded screw for contacting a respective metal end of said halogen bulb.

8. The light assembly of claim 1 further including a dome being configured to shield said halogen bulb and absorb heat emitted from said halogen bulb, said dome being secured to said base.

9. The light assembly of claim 8 wherein each of said first ends of said plurality of support arms is secured directly to a portion of the ceiling fan.

10. The light assembly of claim 8 further including a plate secured to said base in a manner such that a space is defined therebetween, said post of each of said first and second mounting brackets extending through said base and said plate.

11. The light assembly of claim 1 further including a plate secured to said base in a manner such that a space is defined therebetween, each of said first and second mounting brackets including a post which extends through said base and said plate and receives an electrical connection in communication with the source.

12. The light assembly of claim 11 wherein each of said first and second mounting brackets includes a threaded opening for receiving a threaded screw, said threaded screw for contacting a respective metal end of said halogen bulb.

13. A light assembly for securing to an existing ceiling fan, said light assembly comprising:

a plurality of support arms radially extending from and connecting to the ceiling fan, each of said plurality of support arms defining a first end and a second end;

a fixture secured to said second end of each of said plurality of support arms, said fixture defining a base and a first and second mounting bracket secured to said base, each of said first and second mounting brackets having a post which extends through said base and receives an electrical connection in communication with a source, each of said first and second mounting brackets defining a threaded opening for receiving a threaded screw; and a halogen bulb being supported by said fixture, said first and second mounting brackets being positioned on said base to receive said halogen bulb therebetween, said threaded screw for contacting a respective metal end of said halogen bulb, said first and second mounting brackets transmitting electricity from a source via said posts to said halogen bulb and via said threaded screws to power said halogen bulb.

14. The light assembly of claim 8 further including a dome being configured to shield said halogen bulb and absorb heat emitted from said halogen bulb, said dome being secured to said base.

* * * * *